US011274831B2

(12) United States Patent
Sanchez

(10) Patent No.: US 11,274,831 B2
(45) Date of Patent: Mar. 15, 2022

(54) FUEL INJECTOR NOZZLE FOR COMBUSTION TURBINE ENGINES INCLUDING THERMAL STRESS-RELIEF VANES

(71) Applicant: Siemens Energy Global GmbH & Co. KG, Munich (DE)

(72) Inventor: Fabian Enrique Sanchez, Montreal (CA)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 329 days.

(21) Appl. No.: 16/482,061

(22) PCT Filed: Mar. 13, 2017

(86) PCT No.: PCT/US2017/022043
§ 371 (c)(1),
(2) Date: Jul. 30, 2019

(87) PCT Pub. No.: WO2018/169507
PCT Pub. Date: Sep. 20, 2018

(65) Prior Publication Data

US 2020/0003421 A1 Jan. 2, 2020

(51) Int. Cl.
*F23R 3/28* (2006.01)
*F23R 3/14* (2006.01)
(Continued)

(52) U.S. Cl.
CPC ..... *F23R 3/286* (2013.01); *F23D 11/107* (2013.01); *F23D 11/383* (2013.01); *F23R 3/14* (2013.01);
(Continued)

(58) Field of Classification Search
CPC .... F23R 3/28; F23R 2900/00004; F23R 3/14; F23R 3/286; F23D 11/10; F23D 11/38;
(Continued)

(56) References Cited

U.S. PATENT DOCUMENTS 5,415,539 A * 5/1995 Musil ..... F23C 7/004 239/404
5,761,907 A 6/1998 Pelletier et al.
(Continued)

FOREIGN PATENT DOCUMENTS

CA 2720934 A1 10/2009
DE 112009000728 T5 2/2011
(Continued)

OTHER PUBLICATIONS

PCT International Search Report and Written Opinion of International Searching Authority dated Nov. 16, 2017 corresponding to PCT International Application No. PCT/US2017/022043 filed Mar. 13, 2017.

*Primary Examiner* — Gerald L Sung
*Assistant Examiner* — Rene D Ford

(57) ABSTRACT

A fuel injection nozzle for a combustion turbine engine has thermal stress-relief vanes, which accommodate and relieve localized thermal stresses within its monolithic, three-dimensional nozzle structure, imparted by heat transfer during engine combustion. At least one first vane is coupled to opposing, spaced nozzle sleeves at both ends. At least one cantilever-like second vane is coupled to one of the opposing sleeves on one end, while the other free or floating end is spaced by a second vane gap from the other opposing sleeve. Some embodiments include a plurality of second vanes, which have locally varying orientation, and/or structure, and/or second vane gaps, for normalizing spatially and/or temporally thermal stresses within the nozzle structure. The
(Continued)

monolithic structure is fabricated, in some nozzle embodiments, by additive manufacturing.

19 Claims, 6 Drawing Sheets

(51) Int. Cl.
*F23D 11/10* (2006.01)
*F23D 11/38* (2006.01)

(52) U.S. Cl.
CPC ..... *F05D 2240/35* (2013.01); *F23D 11/10* (2013.01); *F23D 11/38* (2013.01); *F23D 2900/14021* (2013.01); *F23R 3/28* (2013.01)

(58) Field of Classification Search
CPC ..... F23D 2900/11101; F23D 11/107; F23D 11/383; F23D 2900/14021; F05D 2240/35; F23C 2900/07001
See application file for complete search history.

(56) References Cited

U.S. PATENT DOCUMENTS

| | | | | |
|---|---|---|---|---|
| 6,134,780 | A | 10/2000 | Coughlan et al. | |
| 6,684,641 | B2 * | 2/2004 | Moriya | F23D 14/02 60/737 |
| 6,854,258 | B2 * | 2/2005 | Moriya | F23D 14/02 60/39.465 |
| 8,806,871 | B2 | 8/2014 | McMasters et al. | |
| 9,400,104 | B2 | 7/2016 | Low et al. | |
| 2004/0021235 | A1 | 2/2004 | Corr, II et al. | |
| 2011/0023494 | A1 * | 2/2011 | Butler | F23R 3/286 60/748 |
| 2013/0227951 | A1 | 9/2013 | Krichever et al. | |
| 2014/0367494 | A1 * | 12/2014 | Donovan | F23D 11/38 239/400 |
| 2014/0367495 | A1 | 12/2014 | Monaghan et al. | |
| 2015/0069148 | A1 | 3/2015 | Ryon et al. | |
| 2015/0285504 | A1 | 10/2015 | Melton | |
| 2015/0292743 | A1 * | 10/2015 | Mook | F23R 3/283 60/806 |
| 2016/0363320 | A1 * | 12/2016 | Benjamin | F23R 3/286 |

FOREIGN PATENT DOCUMENTS

| | | | |
|---|---|---|---|
| GB | 2471238 | B2 | 11/2013 |
| GB | 2526416 | A | 11/2015 |
| JP | 5726066 | B2 | 5/2015 |
| WO | 2009126483 | A2 | 10/2009 |
| WO | 2015112385 | A1 | 7/2015 |
| WO | 2015147934 | A1 | 10/2015 |
| WO | 2015147935 | A1 | 10/2015 |

* cited by examiner

FUEL INJECTOR NOZZLE FOR COMBUSTION TURBINE ENGINES INCLUDING THERMAL STRESS-RELIEF VANES

TECHNICAL FIELD

The invention relates to fuel injectors for use in combustors or burners of combustion turbine engines. More particularly, the invention relates to fuel injector nozzles with thermal stress-relief vanes, which accommodate and relieve localized thermal stresses within the monolithic, three-dimensional nozzle structure, imparted by heat transfer during engine combustion. At least one first vane is coupled to the opposing sleeves at both ends. At least one of a second vane is coupled to one of the opposing sleeves on one end, while the other end is spaced by a second vane gap from the other opposing sleeve.

BACKGROUND

Combustors, also referred to as burners, for combustion turbine engines are oriented within the combustion section of the engine. Each combustor incorporates at least one fuel injector with at least one nozzle and a downstream combustion chamber.

Some known types of combustors incorporate fuel injector nozzles having two or more nested, concentric, spaced annular sleeves. Passages between the nested and spaced sleeves transport air or fuel from an upstream axial end of the nozzle to a downstream tip. Typically, at least one passage transports fuel and one or more other passages transport compressed air from the engine's compressor section. Some dual fuel combustors have two fuel transport passages, for selectively transporting liquid or gaseous fuel. Opposed, nested sleeve surfaces that form the fuel passage or passages, have rigidly coupled, radially oriented vanes, which span the corresponding fuel passage. Such coupled vanes include swirler vanes. The vanes maintain the radially spaced orientation between opposing sleeve surfaces, and in may embodiments, the vanes are used for flow direction and control of fluids that are transported within the generally annular passages. Typical fuel injector nozzles for combustors are constructed from one or more castings, forgings, and/or stamped or machined components. In many known nozzles, sub-components are joined by welding or brazing, to form the completed fuel injection nozzle.

During engine operation within a combustor, different local portions within the three-dimensional structure of the fuel injection nozzle are exposed to different temperatures. For example, the axial, downstream tip of the nozzle is subject to greater heating from combustion gasses than the axial upstream tip. The axial upstream tip is cooled by incoming compressed air from the compressor. As such, the downstream nozzle tip is subject to greater circumferential and axial thermal expansion than the upstream nozzle tip. Similarly, outermost nozzle sleeves or innermost pilot nozzle sleeves are exposed to higher temperature from the combustion gasses than intermediate sleeves that form air or fuel, fluid transport passages. Relatively cooler air or fuel fluids moving through the passages cool the passage-forming sleeve walls and their corresponding vanes within those passages. There are also potential overall temperature differences between different combustor locations within the combustion section of an engine, which are attributable to localized variances in compressed air mass flow as the air is directed from the compressor outlet to the various combustors. For example, a combustor located at a twelve o'clock, top dead center within the combustion section may have a spatially and/or temporally different compressed air and/or combustion gas mass flow than a comparable combustor located at six o'clock, bottom dead center.

Localized spatial temperature exposure variances within the fuel nozzle three-dimensional structure induce temperature gradients and localized differences in thermal stress during steady state engine operation. Engine start-stop thermal cycling, and/or pulsations in combustion and/or compressed air supply, induces temporal as well as spatial localized thermal stress differences within fuel injector nozzles. In general, local thermal stress concentrations can induce permanent deformation and/or crack failure within the nozzle structure, which adversely reduce combustor performance and service life. An exemplary high thermal stress concentration zone within fuel injection nozzles of a combustor is at the welded or brazed coupling interface of vane axial ends and their opposing sleeve surface, or at the corresponding structural zone in nozzle sleeves/vanes metal castings. In some known fuel nozzle designs for combustors, the combustor sleeves and vanes are formed with relatively thin walls that deform plastically in response to thermal stress concentrations. The thin wall construction reduces cracking failure propensity of the component, by deformation rather than failure, but leaves the component susceptible to permanent, thermally induced deformation in zones of high thermal stress.

SUMMARY

Exemplary embodiments described herein reduce localized thermal stress concentrations in fuel injector nozzles for combustors of combustion turbine engines, in order to reduce likelihood of thermally induced cracking or permanent deformation within the nozzle structure. Fuel injector nozzle embodiments described herein have monolithic construction, with cantilever-like, vanes, for reducing and in some embodiments normalizing, localized thermally induced stress within the nozzle structure. In some embodiments, a vane row, such as a swirler vane row, has at least one first type vane with radial ends rigidly coupled to the respective, opposed inner and outer sleeve surfaces. Second types of vanes in the vane row are attached at only one radial end, in cantilever-like fashion. The cantilever-like, unattached radial end defines a second vane gap between itself and its opposing sleeve surface within the nozzle. The second vane gaps in the second vanes prevent accumulation of thermal stresses caused by unequal, localized thermal heating and heat transfer within the nozzle structure. In some embodiments, local second vane gap is adjusted to compensate for locally varying thermal gradients. Rigid attachment of at the least one first vane type maintains mechanical structural integrity (e.g., axial, torsional, and anti-clocking twist) of the adjoining vanes and sleeves. The second type, cantilever-like vanes maintain relative radial concentricity of the sleeves, while their unattached "floating" ends avoid thermal stress concentration zones. In some embodiments, the second vane gaps of the second type vanes are locally varied to compensate for localized differences in thermal expansion and contraction among opposing nozzle sleeves and their intermediate vanes. In some embodiments, the second vane gaps of the second vanes, as well as the opposing nozzle sleeves are thermally modeled.

In some embodiments, thermal properties of a first fuel injector nozzle are modeled in a combustor burner. The modeled first nozzle has concentric sleeves, bridged by a first rigid type and second type, cantilevered vane. Thermal stress modeling includes modeling of the fluid flows and combustion within the modeled combustor. During the modeling, orientation and structure of the first and second vane types and/or second vane gap are selectively varied, in order to normalize spatially and/or temporally, local thermal stresses within the nozzle. The reduced and/or normalized thermal stress concentrations resulting from selective variation of the vane orientations, structure, and/or the second vane gaps are incorporated in a second model of a fuel injector nozzle. The second model is then fabricated as a fuel injector nozzle and installed within a combustor or burner, for ultimate installation within the combustion section of a gas turbine engine.

Exemplary embodiments of the invention feature a fuel injector nozzle for a gas turbine engine. The fuel injector nozzle has first and second annular sleeves respectively having inner and outer circumferential walls, and axial length. The sleeves nested, concentrically aligned, and radially spaced. A first fluid passage is defined between the inner circumferential wall of the first sleeve and the outer circumferential wall of the second sleeve. A first discharge opening is located at a downstream axial end of the first fuel injector nozzle, in fluid communication with the first fluid passage. A first vane has a first end coupled to the inner circumferential wall of the first sleeve, and a second end coupled to the outer circumferential wall of the second sleeve. A second vane is circumferentially or axially spaced from the first vane, having a first end coupled to only one of the inner circumferential wall of the first sleeve or the outer circumferential wall of the second sleeve. The second vane has a second end in a radially opposed and spaced relationship with the other, non-coupled circumferential wall of the first sleeve or the second sleeve. A second vane gap is defined between the second end of the second vane and its opposed, non-coupled circumferential wall of the corresponding other sleeve. The first and second annular sleeves and the first and second vanes are formed in a monolithic, three-dimensional structure.

Other exemplary embodiments of the invention feature a fuel injector nozzle for a gas turbine engine. The fuel injector nozzle has first, second and third annular sleeves, respectively having inner and outer circumferential walls, and axial length. Those sleeves are nested, concentrically aligned, and radially spaced. A first fluid passage is defined between the inner circumferential wall of the first sleeve and the outer circumferential wall of the second sleeve. There is a first discharge opening at a downstream axial end of the first fuel injector nozzle, in fluid communication with the first fluid passage. A second fluid passage is defined between the inner circumferential wall of the second sleeve and the outer circumferential wall of the third sleeve. There is a second discharge opening at the downstream axial end of the first fuel injector nozzle, in fluid communication with the second fluid passage. A first vane has a first end coupled to the inner circumferential wall of the first sleeve, and a second end coupled to the outer circumferential wall of the second sleeve. A second vane is circumferentially or axially spaced from the first vane. The second vane has a first end coupled to only one of the inner circumferential wall of the first sleeve or the outer circumferential wall of the second sleeve, and a second end in a radially opposed and spaced relationship with the other, non-coupled circumferential wall of the first sleeve or the second sleeve. A second vane gap is defined between the second end of the second vane and its opposed, non-coupled circumferential wall of the corresponding other sleeve. A third vane has a first end coupled to the inner circumferential wall of the second sleeve, and a second end coupled to the outer circumferential wall of the third sleeve. A fourth vane is circumferentially or axially spaced from the third vane. The fourth vane has a first end coupled to only one of the inner circumferential wall of the second sleeve or the outer circumferential wall of the third sleeve, and a second end in a radially opposed and spaced relationship with the other, non-coupled circumferential wall of the second sleeve or the third sleeve. A fourth vane gap is defined between the second end of the fourth vane and its opposed, non-coupled circumferential wall of the corresponding other sleeve. The first, second and third annular sleeves, and the first, second, third and fourth vanes are formed in a monolithic, three-dimensional structure.

Additional exemplary embodiments of the invention feature a combustor for a combustion section of a gas turbine engine. The combustor includes a monolithically formed, three-dimensional fuel injector nozzle, which in turn has first, second and third annular sleeves. Those sleeves respectively have inner and outer circumferential walls, and axial length: they are nested, concentrically aligned, and radially spaced. A first fluid passage is defined between the inner circumferential wall of the first sleeve and the outer circumferential wall of the second sleeve. A second fluid passage is defined between the inner circumferential wall of the second sleeve and the outer circumferential wall of the third sleeve. The fuel injector nozzle has a plurality of axially aligned and circumferentially clocked rows of first vanes, each respectively having a first end coupled to the inner circumferential wall of the first sleeve, and a second end coupled to the outer circumferential wall of the second sleeve. The fuel injector nozzle also has a plurality of rows of plural second vanes, axially aligned with and circumferentially spaced from each corresponding first vane, each respectively having a first end coupled to only one of the inner circumferential wall of the first sleeve or the outer circumferential wall of the second sleeve, and a second end in a radially opposed and spaced relationship with the other, non-coupled circumferential wall of the first sleeve or the second sleeve. A second vane gap is defined between the second end of the second vane and its opposed, non-coupled circumferential wall of the corresponding other sleeve. The fuel injection nozzle has a plurality of axially aligned and circumferentially clocked rows of third vanes, each respectively having a first end coupled to the inner circumferential wall of the second sleeve, and a second end coupled to the outer circumferential wall of the third sleeve. The fuel injection nozzle has a plurality of rows of plural fourth vanes, axially aligned with and circumferentially spaced from each corresponding third vane. Each fourth vane has a first end coupled to only one of the inner circumferential wall of the second sleeve or the outer circumferential wall of the third sleeve, and a second end in a radially opposed and spaced relationship with the other, non-coupled circumferential wall of the second sleeve or the third sleeve. A fourth vane gap is defined between the second end of the fourth vane and its opposed, non-coupled circumferential wall of the corresponding other sleeve. A first fluid discharge opening is in fluid communication with the first fluid passage, at a downstream axial end of the fuel injector nozzle. A second fluid discharge opening is in fluid communication with the second fluid passage, at the downstream axial end of the first fuel injector nozzle. The first, second and third annular sleeves, and the first, second, third and fourth vanes are formed in the monolithic, three-dimensional structure. The combustor includes a first fuel delivery system coupled proximal to an upstream end of the fuel injector nozzle, in fluid communication with the first fluid passage, for delivering a first fuel out of the first discharge opening at the downstream axial end of the fuel injector nozzle. The combustor includes a second fuel delivery system coupled proximal to the upstream end of the fuel injector nozzle, in fluid communication with the second fluid passage, for delivering a different, second fuel out of the second discharge opening at the downstream axial end of the fuel injector nozzle. The fuel injector nozzle of the combustor has first airflow through passage, having a first outlet that is in communication with the downstream axial end of the fuel injector nozzle, for delivering compressed air to the downstream axial end of the fuel injector nozzle. A second airflow through passage is defined by the inner circumferential wall of the third annular sleeve of the first fuel injector nozzle. The second airflow through passage has a second outlet that is in communication with the downstream axial end of the fuel injector nozzle, for delivering compressed air to the downstream axial end of the fuel injector nozzle. A combustion chamber is oriented downstream of the downstream axial end of the fuel injector nozzle and the respective first and second outlets of the first and second airflow through passages. The combustion chamber envelops compressed air exhausted from the respective first and second outlets, fuel exhausted from the first and second discharge openings, fuel and air mixture and combustion gas in a combustion zone of the combustion chamber.

The respective features of the exemplary embodiments of the invention that are described herein may be applied jointly or severally in any combination or sub-combination.

BRIEF DESCRIPTION OF DRAWINGS

The exemplary embodiments are further described in the following detailed description in conjunction with the accompanying drawings, in which.

To facilitate understanding, identical reference numerals have been used, where possible, to designate identical elements that are common to the figures. The figures are not drawn to scale.

DESCRIPTION OF EMBODIMENTS

Exemplary embodiments of the fuel injector nozzles described herein are utilized in fuel injectors within combustors (also known as burners) of gas turbine engines. The combustors are located in the combustion section of gas turbine engines. The nozzles have nested, spaced nozzle sleeves, whose spacing is maintained by vanes, such as swirler vanes. The nozzles have fixed, first type vanes, whose opposed ends are coupled to one of the respective, spaced nozzle sleeves. The nozzles also have cantilever-like, second vanes. One end of the second vane is coupled to one of the opposed nozzle sleeves, while the other end of the second vane is spaced by a second vane gap from its other opposed sleeve. In some embodiments orientation and/or structure of the first and/or second vane(s), and/or second vane gap(s) is/are locally varied, in order to normalize local thermal stress, reducing thermal stress concentrations and risk of permanent nozzle deformation or cracks. In some embodiments, combustor is modeled, including a fuel injector, a first fuel injector nozzle (with nozzle sleeves, first and second vanes as described above), a fuel delivery system, an airflow passage, and a combustion chamber. Flows of fuel, air, fuel and air mixture, and combustion gas are simulated in the modeled combustor structure; localized thermally induced stresses imparted in the first fuel injector nozzle are identified. A second monolithically-formed, three-dimensional fuel injector nozzle model is created, by selectively altering in the first fuel injector nozzle any one or more of the orientation of the first and second vanes, or the structure of the first and second vanes, and/or one or more of the second vane gaps, for equalizing and/or temporally normalizing locally varying, thermally induced stresses within the second fuel injector nozzle. It is determined whether the second fuel injector nozzle achieves better uniform thermally induced stress than the first fuel injector nozzle. The model of the second fuel injector nozzle is stored. A combustor is fabricated, incorporating the model of the second fuel injector nozzle.

Figure 1:
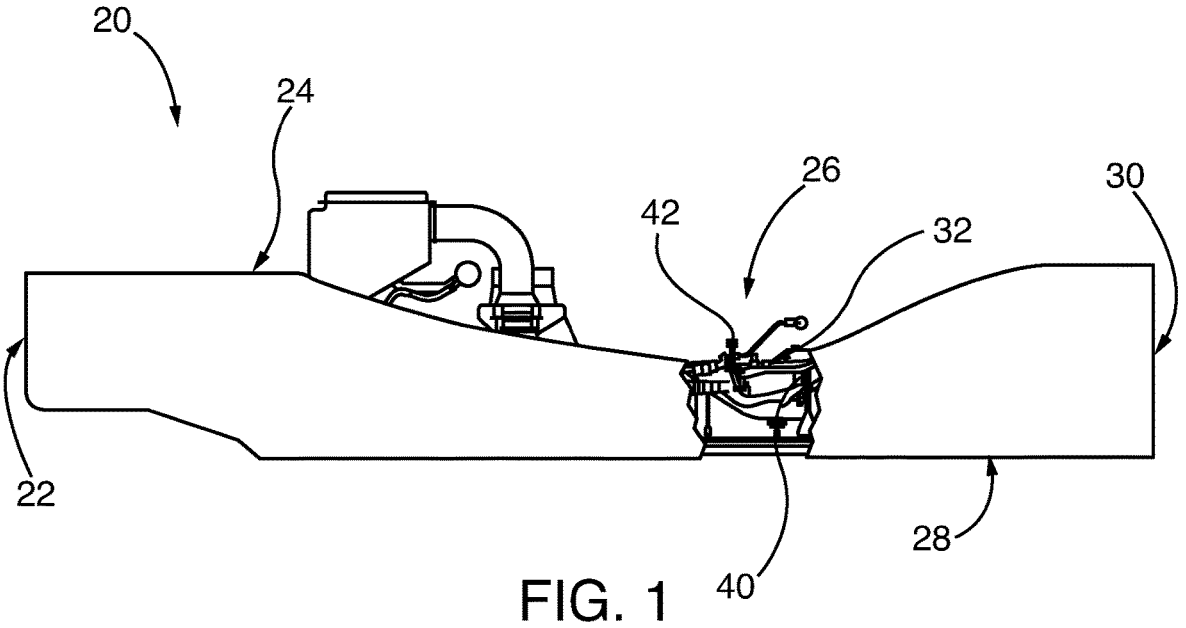
FIG. 1 is a fragmentary, side elevational view of a gas turbine engine, including a combustion section, which incorporates a combustor having a plurality of circumferentially oriented fuel injectors, each respective fuel injector having a fuel injection nozzle that is constructed in accordance with the present invention.
Figure 2:
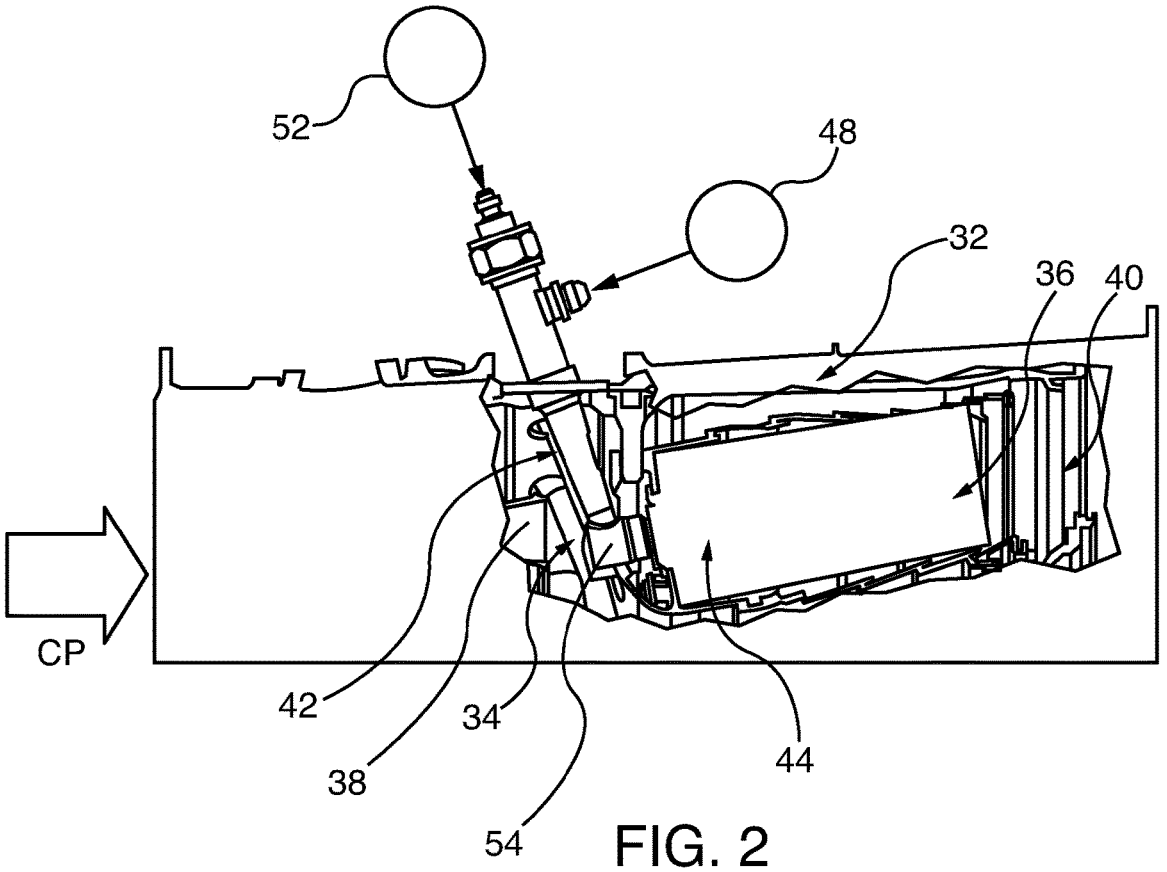
FIG. 2 is an enlarged, cross-sectional view of the combustor and one of the fuel injectors of FIG. 1.
Figure 3:
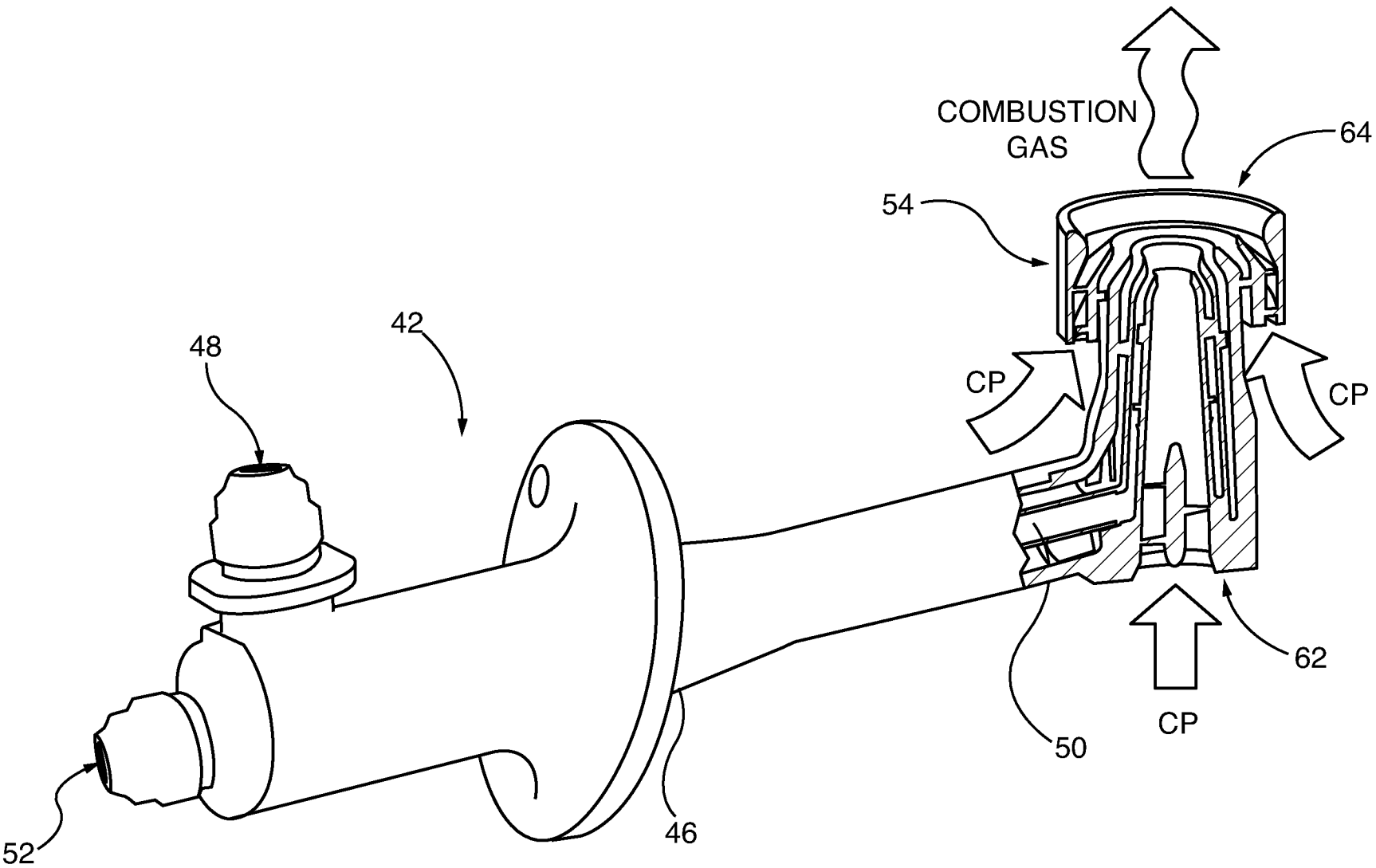
FIG. 3 is a fragmentary, cross-sectional view of the fuel injector of FIG. 2, with a fuel injector head that incorporates a fuel injector nozzle embodiment described herein.

Referring to FIGS. 1 to 3, an annular-flow, industrial gas turbine engine 20, shown in FIG. 1, comprises in axial flow series an inlet 22, a compressor section 24, a combustion section 26 (also sometimes referred to as a combustion chamber assembly), a turbine section 28, and an exhaust 30. The turbine section 28 is arranged to drive the compressor section 24 via one or more rotating shafts (not shown). The combustion section 26 comprises an annular combustor 32 The longitudinal axis of the annular combustor 32 is coextensive with the rotating shaft axis. The inlet 34 of the combustor 32 is at its axially upstream end and the outlet 36 is at the axially downstream end. The casing of the combustion section 26 incorporates an air intake plenum 38, which is in communication with the compressor section 24 compressed air output, for providing compressed air CP to the inlet 34 of the combustor 32. Combustion gas generated within the combustor 32 flows through a corresponding transition 40, and thereafter into the turbine section 28. While an annular combustor is shown in FIGS. 1 and 2, other combustor designs commonly used in combustion turbine engines include, without limitation, so-called can, and can-annular configurations.

The annular combustor 32 includes a circumferential array of fuel injectors 42, which are oriented proximate the combustor inlet 34. A commonly shared, annular combustion chamber 44 is immediately downstream of the injectors 42. In can or can-annular combustors individual fuel injectors or clusters of fuel injectors have dedicated downstream combustion chambers. The fuel injector 42 embodiments described herein are incorporated in can, can-annular, and the annular 44 types of combustion chambers. The fuel injector 42 is a so-called dual fuel injector, which is capable of selectively injecting gaseous (e.g., natural gas or propane), via a first fuel delivery system, or liquid fuel (e.g., fuel oil or aviation jet fuel), via a second fuel delivery system, into the combustion section 26, for mixture with compressed air CP supplied by the compressor section 24, subsequent ignition by an ignitor (not shown), followed by sustained combustion within the annular combustion chamber 44. Referring to FIGS. 2 and 3, the fuel injector 42 is coupled to the combustor section 26; it includes a hollow injector body 46, which is in selective communication with a gaseous fuel source 48 of the first fuel delivery system. The hollow injector body envelops a liquid fuel tube 50, which is in selective communication with a liquid fuel source 52 of the second fuel delivery system.

Figure 4:
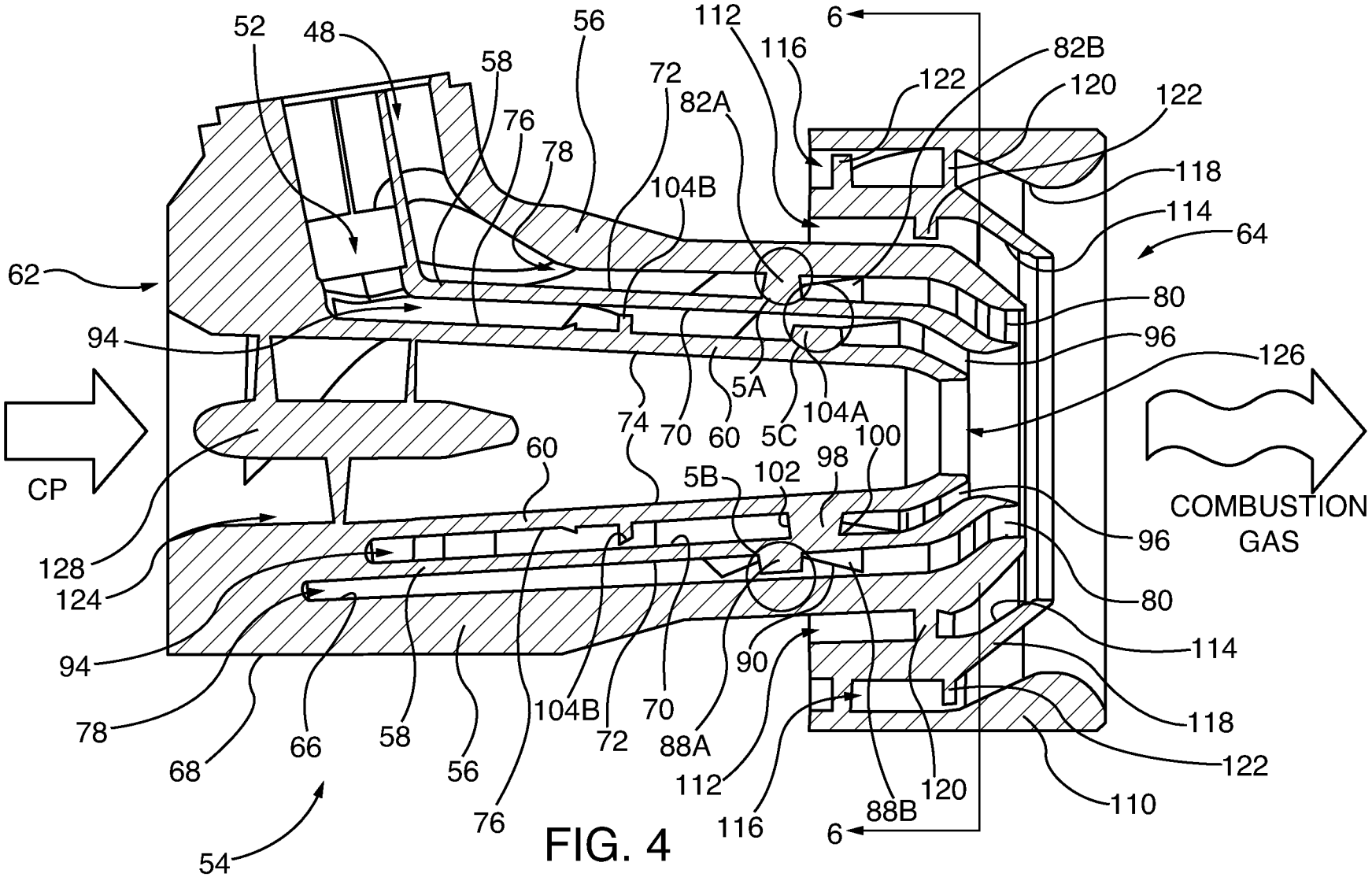
FIG. 4 is an enlarged, axial cross-sectional view of the fuel injector head of FIGS. 2 and 3, with its fuel injector nozzle, showing fixed first and third vanes, and cantilevered or "floating" second and fourth vanes.
Figure 5A:
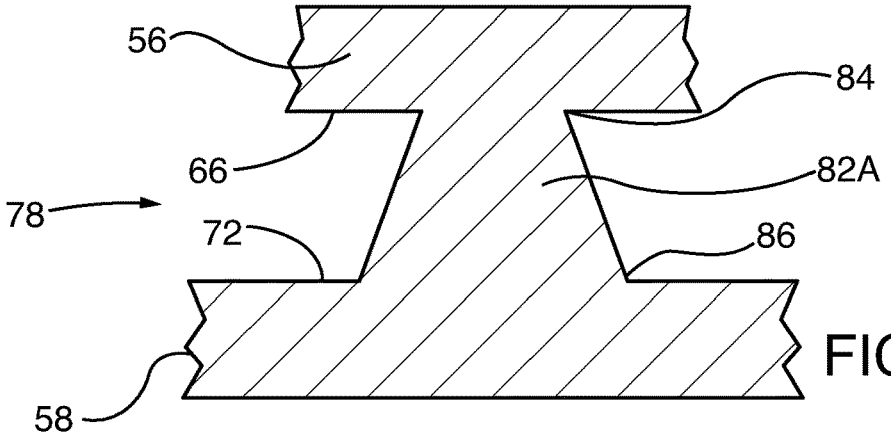
FIG. 5A is a bubble enlargement of an exemplary fixed first vane.
Figure 5B:
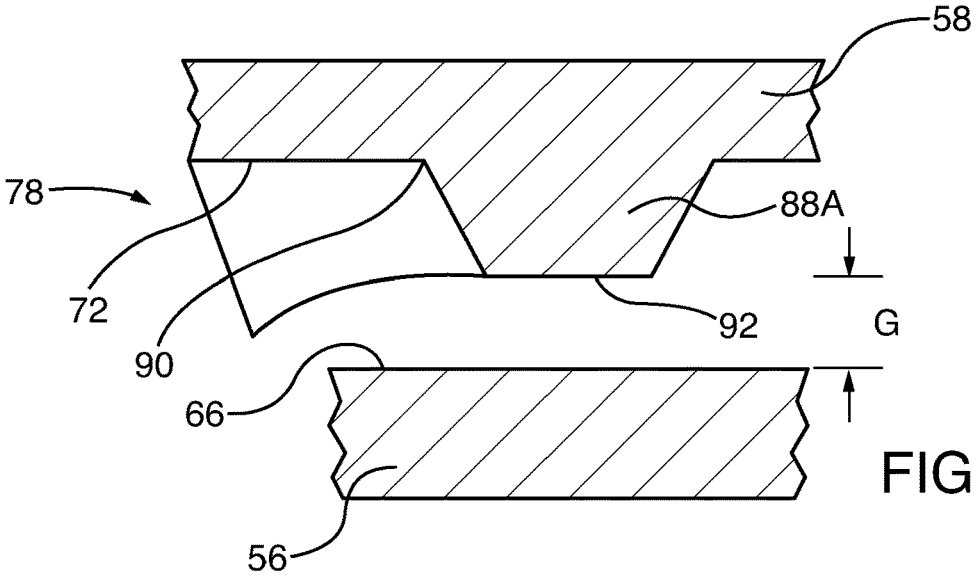
FIG. 5B is a bubble enlargement of an exemplary, cantilever-like second vane, showing a second vane gap G.
Figure 5C:
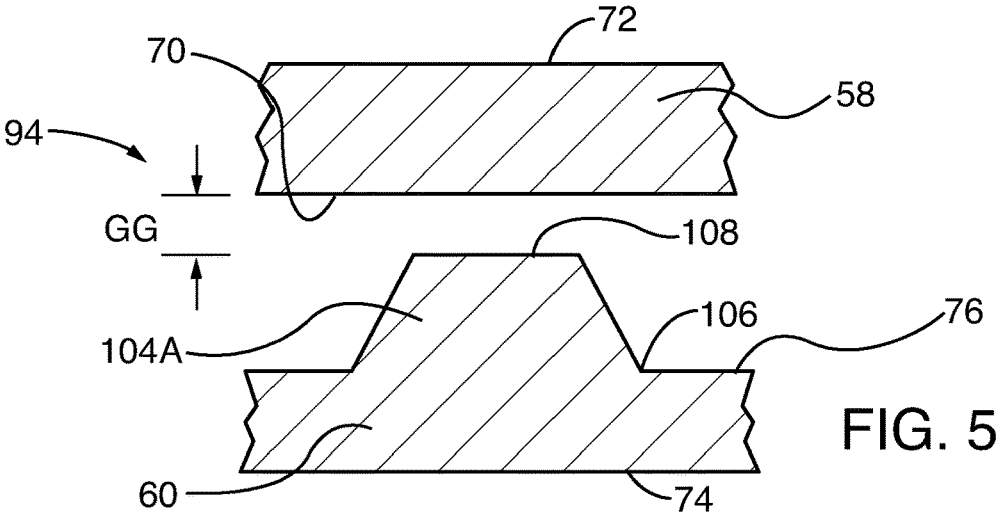
FIG. 5C is a bubble enlargement of an exemplary, cantilever-like fourth vane, in another vane row, showing a fourth vane gap GG.
Figure 6:
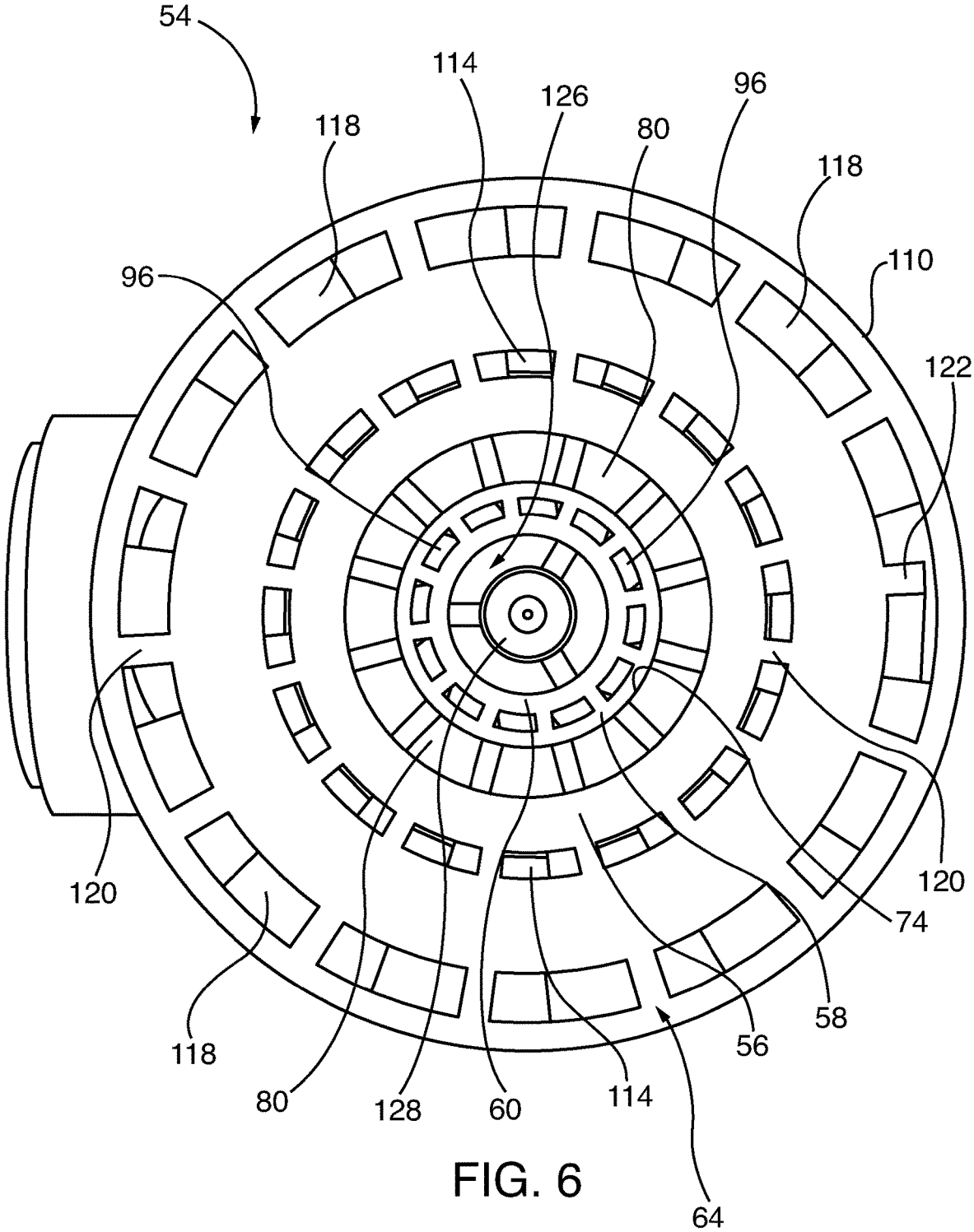
FIG. 6 is a circumferential, cross sectional view of the fuel injector head and fuel injector nozzle of FIG. 4, taken along 6-6 thereof.

Referring to FIGS. 3-6, the fuel injector 42 has an injector nozzle head 54, which incorporates a monolithically formed, three-dimensional, fuel injector nozzle. In the embodiments of FIGS. 4-6, the fuel injector nozzle has first 56, second 58, and third 60 annular sleeves. The respective sleeves 56, 58, 60 are nested, concentrically aligned, and radially spaced, have inner and outer circumferential walls, and axial length that extends from an upstream axial end 62 to a downstream axial end 64 of the fuel injector nozzle's nozzle head 54. More specifically, the first annular sleeve 56 has an inner circumferential wall 66 and an outer circumferential wall 68. The second annular sleeve 58 has an inner circumferential wall 70 and an outer circumferential wall 72. The third annular sleeve 60 has an inner circumferential wall 74 and an outer circumferential wall 76.

The fuel injection nozzle formed in the nozzle head 54 defines a first fluid passage 78 between the inner circumferential wall 66 of the first sleeve 56 and the outer circumferential wall 72 of the second sleeve 58. The first fluid passage 78 terminates in, and is in fluid communication with a first fluid discharge opening 80, at the downstream axial end 64 of the nozzle head 54 and its fuel injector nozzle. The gaseous fuel source 48 of the first fuel delivery system is coupled the nozzle head 54 proximate to an upstream end 62 of the fuel injector nozzle, in fluid communication with the first fluid passage 78, for delivering of the first (gaseous) fuel out of the first discharge opening 80 at the downstream axial end 64 of the fuel injector nozzle's nozzle head 54.

First vanes 82A and 82B span the first fluid passage 78 and maintain radial spacing of the first annular sleeve 56 and the second annular sleeve 58. In some embodiments, either or both of the first vanes 82A and 82B is a/are swirler vane (s), for imparting swirling fluid flow in fuel flowing through the first fluid passage 78. In some embodiments, (not shown) the fuel injector nozzle of the nozzle head 54 has a single first vane or more than two first vanes. The first vanes 82A (see detailed FIG. 5A) and 82B respectively have a first end 84 coupled to the inner circumferential wall 66 of the first sleeve 56, and a second end 86 coupled to the outer circumferential wall 72 of the second sleeve 58. The first vane 82A is one of a first circumferential row of axially aligned vanes and the first vane 82B is one of a second circumferential row of axially aligned vanes, both of which are clocked at different circumferential positions in the fuel injector nozzle's nozzle head 54. For example, the first vane 82A is oriented at the twelve o-clock circumferential position of FIG. 6, while the first vane 82B is oriented at the one o'clock position. Circumferentially clocking, and/or axially spacing the first vanes 82A and 82B at different positions about the fuel injector nozzle distributes axial-, radial-, and torsional-oriented thermal stresses at different, axially separated, spatial locations within the nozzle head 54. Rigid coupling of the first vanes 82A and 82B maintains relative axial, radial, and circumferential/torsional structural alignment and integrity between the first sleeve 56 and the second sleeve 58, but at the expense of increased local thermal stress concentrations at the coupling site of the respective vane first ends 84 and the inner circumferential wall 66 of the first sleeve 56, and at the site of the respective second ends 86 and the outer circumferential wall 72 of the second sleeve 58.

In some embodiments, in order to mitigate local thermal or mechanical stress concentrations attributable to the rigid first vanes, such as the first vanes 82A and 82B, corresponding rows of one or more second vanes 88A and 88B, are axially aligned with and circumferentially spaced from each corresponding first vanes 82A and 82B. In other embodiments, one or more of the second vanes are not axially aligned with a first vane. Unlike the first vanes, each of the cantilever-like second vanes 88A (see detailed FIG. 5B) and 88B respectively has a first end 90 coupled to only one of the inner circumferential wall 66 of the first sleeve 56 or the outer circumferential wall 72 of the second sleeve 58, but its respective second end 92 terminates in a free-floating, radially opposed and spaced relationship with the other, non-coupled circumferential wall of the first sleeve or the second sleeve, defining a second vane gap G there between. In the embodiment of FIG. 5B, the first end 90 of the second vane 88A is coupled to the outer circumferential wall 72 of the second sleeve 58, and its terminating second end 92 is spaced by a second vane gap G from inner circumferential wall 66 of the first sleeve 58. In contrast, the first end 90 of the second vane 88B is coupled to the inner circumferential wall 66 of the first sleeve 56, while its corresponding second end (not shown) is spaced from the outer circumferential wall 72 of the second sleeve 58, by a second vane gap (not shown).

In some embodiments, the second vane gaps G for each respective second vane of the pluralities of rows of second vanes (e.g., second vanes 88A and 88B) are selectively varied to compensate for local thermal stress concentration variations. The cantilever-like second vanes 88A and 88B maintain radial indexing and spacing between the first sleeve 56 and the second sleeve 58, but their free-floating second ends 92 isolate differences in thermal expansion between those vanes and the corresponding sleeves. In order to prevent radially oriented thermal stresses among the first sleeve 56, the second sleeve 58 and the second vanes 88A and 88B, or any other second vanes, the corresponding second vane gap G for each second vane is selected so that relative, radially oriented thermal growth of the second vane during operation of the engine 20 does not deflect radially either of the first or second sleeves. Radially oriented biasing force generated by the pressurized fuel flow through the first fluid passage 78 helps to inhibit relative collapse of the second vane gaps G during engine operation.

The fuel injection nozzle formed in the nozzle head 54 defines a second fluid passage 94, between the inner circumferential wall 70 of the second sleeve 58 and the outer circumferential wall 76 of the third sleeve 60. The second fluid passage 94 terminates in, and is in fluid communication with a second fluid discharge opening 96, at the downstream axial end 64 of the fuel injector nozzle and nozzle head 54. The liquid fuel source 52 of the second fuel delivery system is coupled the nozzle head 54, via the liquid fuel tube 50, proximate to an upstream end 62 of the fuel injector nozzle, in fluid communication with the second fluid passage 94, for delivering of the second (liquid) fuel out of the second discharge opening 96 at the downstream axial end 64 of the fuel injector nozzle's nozzle head 54.

A third-type rigid vane 98 is constructed similar to the first vanes 82A and 82B; it spans the second fluid passage 94 and maintains radial spacing of the second annular sleeve 58 and the third annular sleeve 60. In some embodiments, the third vane 98 is a swirler vane, for imparting swirling fluid flow in fuel flowing through the second fluid passage 94. The third vanes 98 has a first end 100 coupled to the inner circumferential wall 70 of the second sleeve 58, and a second end 102 coupled to the outer circumferential wall 76 of the third sleeve 60. In some embodiments, (not shown) the fuel injector nozzle of the nozzle head 54 has two or more third vanes, which in some embodiments are circumferentially clocked an/or axially separated relative to each other, in the fuel injector nozzle's nozzle head 54, similar to the first vanes 82A and 82B. Circumferentially clocking, or circumferentially spacing embodiments with multiple third vanes at different positions distributes axial-, radial-, and torsional-oriented thermal stresses at different, axially separated, spatial locations within the nozzle head 54. Rigid coupling of the third vane 98 maintains relative axial, radial, and circumferential/torsional structural alignment between the second sleeve 58 and the third sleeve 60, but at the expense of increased local thermal stress concentrations at the coupling interface site of the vane and the opposed sleeves, as was the case for the first vanes 82A and 82B.

In order to mitigate local thermal or mechanical stress concentrations attributable to the rigid third vane 98 (or multiple third vane embodiments), in some embodiments, corresponding rows of one or more fourth vanes 104, (e.g., the fourth vane 104A in FIG. 5C), are axially aligned with and circumferentially spaced from each corresponding third vane 98, such was done for the first vanes 82A and 82B. Unlike the third vanes, each of the cantilever-like fourth vanes 104 (for example fourth vane 104A in detailed FIG. 5C) respectively has a first end 106 coupled to only one of the inner circumferential wall 70 of the second sleeve 58 or the outer circumferential wall 76 of the third sleeve 60, but its respective second end 108 terminates in a free-floating, radially opposed and spaced relationship with the other, non-coupled circumferential wall of the second sleeve or the third sleeve, defining a fourth vane gap GG there between. In the embodiment of the fourth vane 104A of detailed FIG. 5C, the first end 106 is coupled to the outer circumferential wall 76 of the third sleeve 60, while their respective, corresponding second end 108 is spaced from the inner circumferential wall 70 of the second sleeve 58, by fourth vane gap GG.

In some embodiments, the fourth vane gaps GG for each respective second vane of the pluralities of rows of fourth vanes 104 are selectively varied to compensate for local thermal stress concentration variations, as was done for some embodiments of the second vane gaps G for the second vanes 88A and B. The cantilever-like fourth vanes 104, including fourth vane 104A, maintain radial indexing and spacing between the second sleeve 58 and the third sleeve 60, but their free-floating second ends 108 isolate differences in thermal expansion between those vanes and the corresponding sleeves. In order to prevent radially oriented thermal stresses among the second sleeve 58, the third sleeve 60, and the fourth vanes 104, including 104A, or any other fourth vanes, in some embodiments the corresponding fourth vane gap GG for each fourth vane is selected so that relative, radially oriented thermal growth of the fourth vane during engine 20 operation does not deflect radially either of the second or third sleeves. Radially oriented biasing force generated by the pressurized fuel flow through the second fluid passage 94 helps to inhibit relative collapse of the fourth vane gaps GG during engine 20 operation.

The embodiment of the nozzle head 54 of the fuel injector nozzle in FIGS. 2-4, and 6 incorporates airflow through passages in an air shroud 110, in order to entrain fuel discharged by the first fluid discharge opening 80 or the second fluid discharge opening 96 with compressed air CP, for combustion. Annular-shaped, first airflow through passage 112 has an annular first outlet 114 that is in communication with the downstream axial end 64 of the fuel injector nozzle and nozzle head 54, for delivering compressed air CP for combustion. A second, annular shaped airflow through passage 116 has an annular second outlet 118 that is also is in communication with the downstream axial end 64 of the fuel injector nozzle and nozzle head 54. As shown in FIGS. 4 and 6, the respective first 114 and second 118 annular outlets have fixed, fifth vanes 120, similar in construction to the first vanes 82 and the third vanes 98, as well as cantilever-like, vane-gap defining, sixth vanes 122, similar in construction to the second 88 and fourth 104 vanes.

A third airflow through passage 124, is defined by the inner circumferential wall 74 of the third annular sleeve 60, which has a third outlet 126 that is in communication with the downstream axial end 64 of the fuel injector nozzle. The third airflow passage 124 includes a central swirler 128. The third airflow through passage 124 provides compressed air CP for a pilot combustion flame. Fuel for the pilot combustion flame is routed to the third airflow through passage 124 by known construction fuel passages (not shown), which are in communication with the first fuel passage 78 and/or the second fuel passage 94.

The annular combustion chamber 44 of the annular combustor 32, is oriented downstream of the downstream axial end 64 of the fuel injector nozzle's nozzle head 54 envelops compressed air CP exhausted from the respective first 114, second 116 and third 126 airflow passage outlets, fuel exhausted from the first 80 and second 96 discharge openings, fuel and air mixture and combustion gas. Combustion gas exhausts the combustion chamber 44 and the engine's combustion section 26, via the transition 40 into the turbine section 28 of the engine 20.

In the embodiments of FIGS. 2-6, the entire fuel injector head 54, including its portions that form the fuel injector nozzle, is monolithically formed as a unitary metallic structure by additive manufacture. In some embodiments, the fuel injector nozzle, such as the one formed in the fuel injector head 54, is directly constructed, layer by layer, by fusing metallic powder, with a focused energy source such as a laser, into a monolithic, three-dimensional structure of selectively oriented, opposed sleeves, fixed vanes, and cantilever-like vanes having vane gaps that replicate desired ultimate structure of the fuel injector nozzle. After initial additive manufacture fabrication of the fuel injector head 54, it undergoes final machining and any other, remaining fabrication processes to conform it to finished dimension specifications of the fuel injector head. Metal alloys used to form the fuel injector head 54, including its fuel injector nozzle portions, during additive manufacture processes are typically nickel/cobalt/chromium-based so-called superalloys. Profiles of the locally varying dimension vanes and vane gaps of the various embodiments of the monolithic, three-dimensional fuel injector nozzle of fuel injector head 54 are not readily accomplished by traditional metal component fabrication and welding methods. While unistructural welded metal fuel injector nozzles have been formed in the past, traditional metal cutting methods, including electro-discharge machining ("EDM") cannot readily fabricate complex, vane gaps (e.g., G or GG) of the cantilever-like floating vanes within the nozzle's internal volume space. Traditional metal casting methods, using molds with mold cavities and mold cavity inserts, also cannot readily fabricate complex, internal cantilever-like vanes and vane gaps within the nozzle's internal volume space.

In some embodiments, the respective fuel injector head 54, and its entire nozzle structure formed therein is not formed in a single, additive manufacture monolithic structure. In some embodiments, additive manufacture subcomponents, which incorporate segments of opposed nozzle sleeves, and bridging vanes, and the vane gaps of bridging cantilever-like vanes are formed by additive manufacture, and subsequently joined (e.g., by brazing or welding) to fabricate a complete, composite fuel injector nozzle within a fuel injector head. In other embodiments, additive manufactured, monolithic sleeve/vane subcomponents are used as inserts in, and joined to a separately formed fuel injector head.

Figure 7:
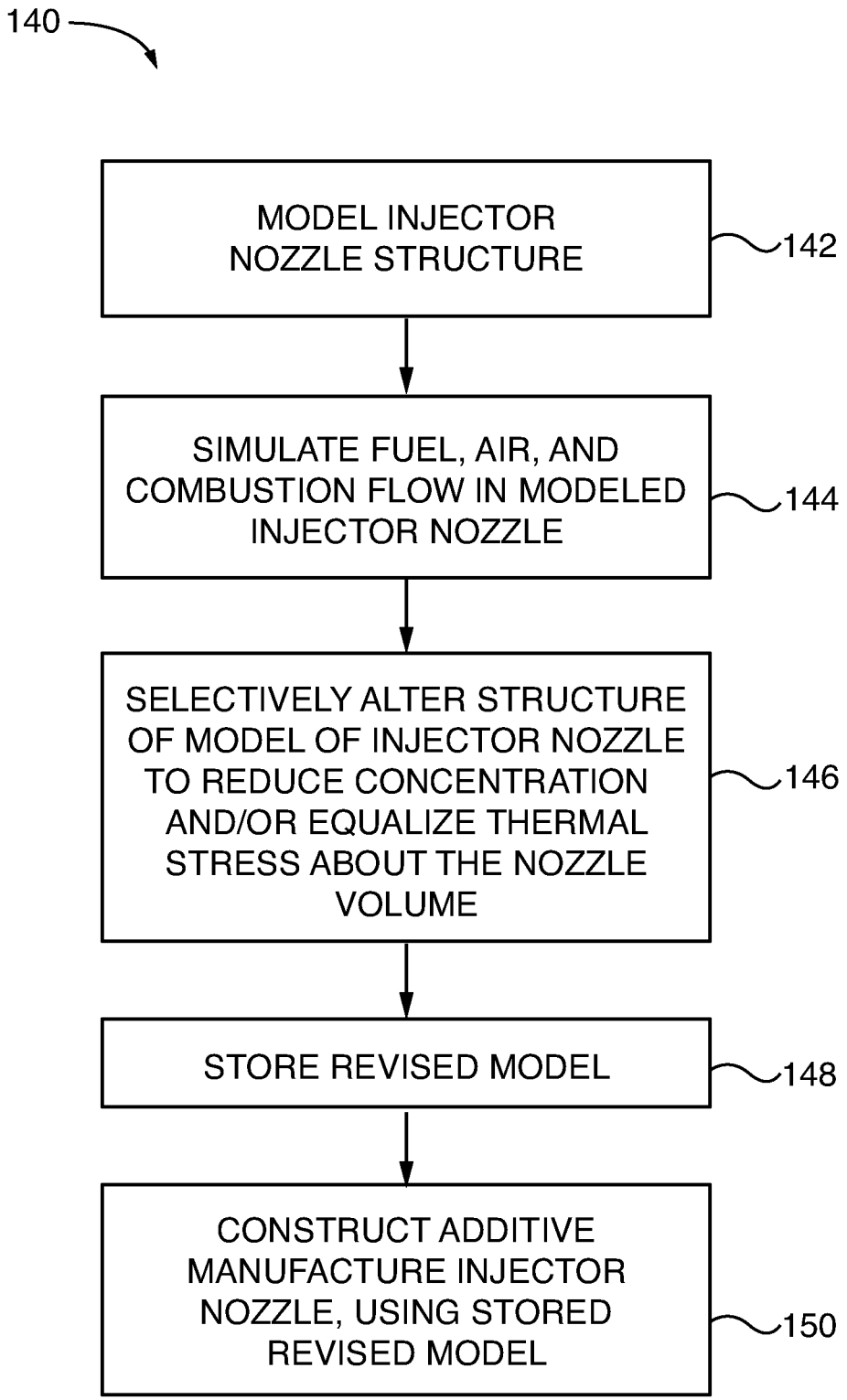
FIG. 7 is a flowchart showing an embodiment of a method for normalizing thermal stress within a fuel injection nozzle of a combustor, by designing and manufacturing the fuel injector nozzle in accordance with the present invention, which has a monolithic, three-dimensional structure of selectively oriented and selectively structured, fixed first type vanes and cantilever-like second type vanes.

Methods for determining profiles and orientations of the various opposing nested sleeves, bridging fixe vanes, bridging cantilever-like vanes and dimensions of vane gaps of cantilever-like vanes throughout the volume of the fuel injector nozzle structure, such as in the fuel injector head 54, is now described in greater detail, with reference to the exemplary method 140 shown in FIG. 7. The exemplary method 140, described herein, is applied to fabrication of the portion of the fuel injector head 54 that forms the fuel injector nozzle, for use in the combustor 32.

At modeling step 142, structure of the combustor 32, including an initial or first-design fuel injector nozzle, of the fuel injector head 54, is modeled in a computer workstation, or the like, running one or more of commercially available structural, fluid dynamics, and thermal modeling software in any combination or sequence.

In step 144, operation of the modeled combustor 32, including the modeled, first fuel injector nozzle portion of the fuel injector head 54, are simulated in a computer workstation, or the like, running commercially available computational fluid dynamics ("CFD") and thermal simulation software. During the simulated operation of the modeled combustor 32, one or more of desired mass flow of intake air CP, gaseous fuel 48, liquid fuel 52, fuel and air mixture, and combustion gas flow dynamics within the annular combustion chamber 44, combustion backpressure dynamics within the annular combustion chamber, and any backpressure propagated upstream into the fuel injector head 54 are monitored and evaluated. Localized spatial and temporal temperatures and thermal stress concentrations within the first fuel injection nozzle model are also monitored and evaluated. Empirical, operational knowledge about fluid flow, localized spatial and temporal temperature variations, and fluid dynamics within the nozzle design of the first fuel injector, based on past physical observation and simulations, are utilized to evaluate the simulations. Local deviations from a desired fuel-air ratio within the fuel and air mixture, throughout the premixer volume and the sources of such deviations are identified and evaluated.

In step 146, the modeled structure of the first fuel injector nozzle of the fuel injector head 54, as well as structure of any other components in the combustor 32, are revised and altered, in order to reduce concentrations of thermal stress, and in some embodiments normalize thermal stress throughout the spatial volume of the first fuel injector nozzle. For example, in some simulation embodiments, localized variations in steady state airflow CP, or normalization of transient pulsations within the air intake plenum 38 of FIG. 2 at different circumferential angular positions or axial position within the combustion section 26 of the engine 20, are compensated by altering locally within the first fuel injector nozzle model the structural profiles, dimensions and/or orientation of one or more of: the fuel nozzle sleeves 56, 58, 60; the vanes 82, 88, 98, 104, 120, 122; the vane gaps G, GG; and the fluid passages 80, 94, 124.

Upon achievement of desired reduction in localized thermal stress in the fuel injector nozzle portion of the fuel injector head 54, and in some additional embodiments normalization of thermal stress, by simulated altering of the injector nozzle structure, those alterations are stored as a revised, second fuel injector model, in step 148 of FIG. 7. Stored alterations include, without limitation, the revised dimensions and/or orientation of one or more of: the fuel nozzle sleeves 56, 58, 60; the vanes 82, 88, 98, 104, 120, 122; the vane gaps G, GG; and the fluid passages 80, 94, 124

In step 150 of FIG. 7, the revised structural model of the second fuel injector, previously stored in step 148, is used to construct the fuel injector head 54 of FIGS. 2-6, by additive manufacture. The modeled, second fuel injector and its associated fuel injector head 54 are constructed as a monolithic, three-dimensional, metallic structure. As previously discussed, in some embodiments, the fuel injector nozzle within the fuel injector head 54 is directly constructed, layer by layer, by fusing metallic powder, with a focused energy source such as a laser, into a monolithic, three-dimensional structure that replicates desired ultimate structure of the second model fuel injector. Metal alloys used to form the fuel injector head 54, as well as other components within the combustor 32, are typically nickel/cobalt/chromium-based so-called superalloys.

The constructed fuel injector head 54, including its fuel injector nozzle portion, is assembled, with other components, into the fuel injector 42 of FIGS. 2 and 3, for incorporation within the annular combustor 32 of the. combustion turbine engine 20 of FIG. 1.

Although various embodiments that incorporate the invention have been shown and described in detail herein, others can readily devise many other varied embodiments that still incorporate the claimed invention. The invention is not limited in its application to the exemplary embodiment details of construction and the arrangement of components set forth in the description or illustrated in the drawings. The invention is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted", "connected", "supported", and "coupled" and variations thereof are used broadly and encompass direct and indirect mountings, connections, supports, and couplings. Further, "connected" and "coupled" are not restricted to physical or mechanical connections or couplings.

What is claimed is:

1. A fuel injector nozzle for a gas turbine engine, comprising:

first and second annular sleeves respectively having inner and outer circumferential walls, and axial length, the sleeves nested, concentrically aligned, and radially spaced;

a first fluid passage defined between the inner circumferential wall of the first sleeve and the outer circumferential wall of the second sleeve;

a first discharge opening at a downstream axial end of the first fuel injector nozzle, in fluid communication with the first fluid passage;

a first vane having a first end coupled to the inner circumferential wall of the first sleeve, and a second end coupled to the outer circumferential wall of the second sleeve;

a second vane, circumferentially or axially spaced from the first vane, having a first end coupled to only one of the inner circumferential wall of the first sleeve or the outer circumferential wall of the second sleeve, and a second end in a radially opposed and spaced relationship with the other, non-coupled circumferential wall of the first sleeve or the second sleeve, defining a second vane gap there between;

wherein the first and second annular sleeves, and the first and second vanes are formed in a monolithic, three-dimensional structure, wherein the first vane comprises a plurality of rows of axially spaced first vanes, each respective first vane having a first end coupled to the inner circumferential wall of the first sleeve, and a second end coupled to the outer circumferential wall of the second sleeve; and wherein the second vane comprises a plurality of rows of axially spaced second vanes, corresponding to and circumferentially spaced from each of the plurality of rows of axially spaced first vanes, each respective second vane having a first end coupled to only one of the inner circumferential wall of the first sleeve or the outer circumferential wall of the second sleeve, and a second end in a radially opposed and spaced relationship with the other, non-coupled circumferential wall of the first sleeve or the second sleeve, defining a second vane gap there between.

2. The fuel injector nozzle of claim 1, wherein the plurality of rows of axially spaced first vanes is oriented at different circumferential positions about the second sleeve.

3. The fuel injector nozzle of claim 1, wherein the plurality of rows of axially spaced second vanes respectively defining different second vane gaps.

4. The fuel injector nozzle of claim 3, wherein the second vane gaps for each respective second vane being respectively arranged to compensate for variations in localized thermal expansion between the second vane and the first and second sleeves.

5. A combustor for a combustion section of a gas turbine engine, including the fuel injector nozzle of claim 1, further comprising:

a fuel delivery system coupled proximal to an upstream end of the fuel injector nozzle, in fluid communication with the first fluid passage, for delivering fuel out of the first discharge opening at the downstream axial end of the fuel injector nozzle;

a first airflow through passage, having a first outlet that is in communication with the downstream axial end of the first fuel injector nozzle, for delivering compressed air to the downstream axial end of the first fuel injector nozzle; and a combustion chamber oriented downstream of the downstream axial end of the fuel injector nozzle and the first outlet of the airflow through passage, for enveloping compressed air exhausted from the first outlet of the airflow through passage, fuel exhausted from the first discharge opening, fuel and air mixture and combustion gas in a combustion zone of the combustion chamber.

6. A fuel injector nozzle for a gas turbine engine, comprising:

first, second and third annular sleeves, respectively having inner and outer circumferential walls, and axial length, the sleeves nested, concentrically aligned, and radially spaced;

a first fluid passage defined between the inner circumferential wall of the first sleeve and the outer circumferential wall of the second sleeve;

a first discharge opening at a downstream axial end of the first fuel injector nozzle, in fluid communication with the first fluid passage;

a second fluid passage defined between the inner circumferential wall of the second sleeve and the outer circumferential wall of the third sleeve;

a second discharge opening at the downstream axial end of the first fuel injector nozzle, in fluid communication with the second fluid passage;

a first vane having a first end coupled to the inner circumferential wall of the first sleeve, and a second end coupled to the outer circumferential wall of the second sleeve;

a second vane, circumferentially or axially spaced from the first vane, having a first end coupled to only one of the inner circumferential wall of the first sleeve or the outer circumferential wall of the second sleeve, and a second end in a radially opposed and spaced relationship with the other, non-coupled circumferential wall of the first sleeve or the second sleeve, defining a second vane gap there between;

a third vane having a first end coupled to the inner circumferential wall of the second sleeve, and a second end coupled to the outer circumferential wall of the third sleeve; and a fourth vane, circumferentially or axially spaced from the third vane, having a first end coupled to only one of the inner circumferential wall of the second sleeve or the outer circumferential wall of the third sleeve, and a second end in a radially opposed and spaced relationship with the other, non-coupled circumferential wall of the second sleeve or the third sleeve, defining a fourth vane gap there between;

the first, second and third annular sleeves, and the first, second, third and fourth vanes formed in a monolithic, three-dimensional structure.

7. The fuel injector nozzle of claim 6, the first and third vanes oriented at different circumferential positions about the second sleeve and/or at different axial positions along the second sleeve.

8. The fuel injector nozzle of claim 6, wherein a respective plurality of the second vanes and/or a respective plurality of the fourth vanes being oriented at different circumferential positions about the second sleeve and/or at different axial positions along the second sleeve.

9. The fuel injector nozzle of claim 8, wherein the plurality of the second vanes respectively defining different second vane gaps.

10. The fuel injector nozzle of claim 9, wherein dimensions of the respective second vane gaps are formed by selectively adjusting length between the first and second ends of the second vanes, during formation of the monolithic structure.

11. The fuel injector nozzle of claim 9, wherein the second vane gaps for each respective second vane being respectively arranged to compensate for variations in localized thermal expansion between the second vane and the first and second sleeves.

12. The fuel injector nozzle of claim 11, wherein dimensions of the respective second vane gaps formed by selectively adjusting length between the first and second ends of the second vanes, during formation of the monolithic structure.

13. The fuel injector nozzle of claim 8, wherein a plurality of the fourth vanes respectively defining different fourth vane gaps.

14. The fuel injector nozzle of claim 13, wherein dimensions of the respective fourth vane gaps are formed by selectively adjusting length between the first and second ends of the fourth vanes, during formation of the monolithic structure.

15. The fuel injector nozzle of claim 13, wherein the fourth vane gaps for each respective fourth vane of the plurality of the fourth vanes being respectively arranged to compensate for variations in localized thermal expansion between the second vane and the first and second sleeves.

16. The fuel injector nozzle of claim 15, wherein dimensions of the respective fourth vane gaps are formed by selectively adjusting length between the first and second ends of the fourth vanes, during formation of the monolithic structure.

17. The fuel injector nozzle of claim 6, the monolithic, three-dimensional structure formed by an additive manufacture process, by fusing metallic powder into the three-dimensional, monolithic structure with an energy source.

18. The fuel injector nozzle of claim 17, any one or more of the sleeves or vanes comprising a first material, by fusing a first metallic powder with the energy source, and others of any one or more of the sleeves or vanes comprising a second material, by fusing a second metallic powder with the energy source during formation of the monolithic, three-dimensional structure.

19. A combustor for a combustion section of a gas turbine engine, comprising:

a monolithically formed, three-dimensional fuel injector nozzle having:

first, second and third annular sleeves, respectively having inner and outer circumferential walls, and axial length, the sleeves nested, concentrically aligned, and radially spaced;

a first fluid passage defined between the inner circumferential wall of the first sleeve and the outer circumferential wall of the second sleeve;

a second fluid passage defined between the inner circumferential wall of the second sleeve and the outer circumferential wall of the third sleeve;

a plurality of axially aligned and circumferentially clocked rows of first vanes, each respectively having a first end coupled to the inner circumferential wall of the first sleeve, and a second end coupled to the outer circumferential wall of the second sleeve;

a plurality of rows of plural second vanes, axially aligned with and circumferentially spaced from each corresponding first vane, each respectively having a first end coupled to only one of the inner circumferential wall of the first sleeve or the outer circumferential wall of the second sleeve, and a second end in a radially opposed and spaced relationship with the other, non-coupled circumferential wall of the first sleeve or the second sleeve, defining a second vane gap there between;

a plurality of axially aligned and circumferentially clocked rows of third vanes, each respectively having a first end coupled to the inner circumferential wall of the second sleeve, and a second end coupled to the outer circumferential wall of the third sleeve;

a plurality of rows of plural fourth vanes, axially aligned with and circumferentially spaced from each corresponding third vane, each respectively having a first end coupled to only one of the inner circumferential wall of the second sleeve or the outer circumferential wall of the third sleeve, and a second end in a radially opposed and spaced relationship with the other, non-coupled circumferential wall of the second sleeve or the third sleeve, defining a fourth vane gap there between;

a first fluid discharge opening, in fluid communication with the first fluid passage, at a downstream axial end of the fuel injector nozzle;

a second fluid discharge opening, in fluid communication with the second fluid passage, at the downstream axial end of the first fuel injector nozzle;

the first, second and third annular sleeves, and the first, second, third and fourth vanes formed in the monolithic, three-dimensional structure; a first fuel delivery system coupled proximal to an upstream end of the fuel injector nozzle, in fluid communication with the first fluid passage, for delivering a first fuel out of the first discharge opening at the downstream axial end of the fuel injector nozzle;

a second fuel delivery system coupled proximal to the upstream end of the fuel injector nozzle, in fluid communication with the second fluid passage, for delivering a different, second fuel out of the second discharge opening at the downstream axial end of the fuel injector nozzle; and a first airflow through passage, having a first outlet that is in communication with the downstream axial end of the fuel injector nozzle, for delivering compressed air to the downstream axial end of the fuel injector nozzle;

a second airflow through passage, defined by the inner circumferential wall of the third annular sleeve of the first fuel injector nozzle, having a second outlet that is in communication with the downstream axial end of the fuel injector nozzle, for delivering compressed air to the downstream axial end of the fuel injector nozzle; and a combustion chamber oriented downstream of the downstream axial end of the fuel injector nozzle and the respective first and second outlets of the first and second airflow through passages, for enveloping compressed air exhausted from the respective first and second outlets, fuel exhausted from the first and second discharge opening, fuel and air mixture and combustion gas in a combustion zone of the combustion chamber.

* * * * *